US006860392B2

(12) United States Patent
Davis et al.

(10) Patent No.: US 6,860,392 B2
(45) Date of Patent: Mar. 1, 2005

(54) DEVICE FOR CONCENTRATING METALLIC COINS PRODUCED FROM SHREDDER OPERATIONS

(75) Inventors: Billy Jack Davis, Cleburne, TX (US); Roy Frosch, Aledo, TX (US)

(73) Assignee: Texas Industries, Inc., Dallas, TX (US)

( * ) Notice: Subject to any disclaimer, the term of this patent is extended or adjusted under 35 U.S.C. 154(b) by 60 days.

(21) Appl. No.: 10/260,949

(22) Filed: Sep. 30, 2002

(65) Prior Publication Data

US 2004/0060847 A1 Apr. 1, 2004

(51) Int. Cl.[7] ..... B07B 1/22; B07B 13/05
(52) U.S. Cl. ..... 209/288; 209/683
(58) Field of Search ..... 209/284, 288, 209/294, 298, 621, 664, 683, 689

(56) References Cited

U.S. PATENT DOCUMENTS 1,301,683 A * 4/1919 Goddu ..... 209/287
1,822,921 A * 9/1931 Cooper ..... 209/664
2,049,808 A * 8/1936 Hunnicutt ..... 209/244
2,875,894 A * 3/1959 Nelson ..... 209/683
2,984,351 A * 5/1961 Van Slyck et al. ..... 209/626
3,241,667 A * 3/1966 Grosbety ..... 209/664
4,149,637 A * 4/1979 Starr ..... 209/621
4,512,881 A * 4/1985 Shumway et al. ..... 209/270
4,560,070 A * 12/1985 Cribiu' et al. ..... 209/664
5,165,548 A * 11/1992 Dumler et al. ..... 209/2
6,305,552 B1 * 10/2001 Coleman ..... 209/664

FOREIGN PATENT DOCUMENTS

GB 2100691 A * 1/1983 ..... B07C/1/12

* cited by examiner

*Primary Examiner*—Donald P. Walsh
*Assistant Examiner*—Joseph C Rodriguez
(74) *Attorney, Agent, or Firm*—Jones Day

(57) ABSTRACT

A separator is disclosed for mechanically separating objects having one size dimension less that a predetermined threshold size. The present separator comprises a cylindrically- or barrel-shaped device having one or more louvers. The barrel is oriented at a preset angle and rotated about its longitudinal axis (along its circumference) and powered by a motorized drive. A collection of objects (processed materials or heavy metal particles from shredder operation) are introduced into the higher opening in the barrel. As the collection of objects progresses downward through the barrel, a plurality of machined slots or louvers separates the larger objects from the smaller. The present invention separates the collection of objects into two separate paths, comprising two products, which are 1) an overflow path, comprised essentially of objects that exceed the maximum allowable size through the louvers and fall through the lower end of the device; and 2) an underflow path, comprised essentially of objects that are able to pass through the louvers. The objects in the underflow path are collected separately from those in the overflow path.

12 Claims, 4 Drawing Sheets

DEVICE FOR CONCENTRATING METALLIC COINS PRODUCED FROM SHREDDER OPERATIONS

BACKGROUND OF THE INVENTION

1. Field of the Invention

The present invention relates to an apparatus for separating objects by size and shape. More particularly, the present invention relates to an apparatus for separating objects based on a size threshold, whereby objects measuring less than a predetermined maximum size in any dimension are separated from objects measuring over the predetermined maximum size threshold. Finally, the present invention relates to an apparatus for sorting relatively planar-shaped objects measuring less than a predetermined threshold size in the non-planar dimension from other larger objects. One example of a planar object to be sorted is coinage.

2. Description of Related Art

The recovery and separation of multiple components of a mixed sample remains an important operation of any recycling system. In shredder residue metal recycling, specifically automobile shredder residue processing, this is no different. Although successful methods have been developed for distinguishing such items as heavy metals, light metals, organics, rubber, etc., it shall prove beneficial to this industry to further extract specific items from such a broad category of materials.

Among the categories are mixed heavy metals, and these may be defined as any non-ferrous metallic substance with a specific gravity greater than approximately 2.8, as compared to water (1.0 g/cm$^3$). In automobile shredder residue processing, this may include copper, zinc, stainless steel, etc. Mixed heavy metals will also include all metallic coins. Separating these coins creates an additional separate product of the monies themselves, and does not diminish the value of the mixed heavy metals from which it was derived. In addition the separated coinage product provides an additional revenue source for the user. At the present time, the exclusive way of separating the coins from the mixed heavy metals is achieved by the tedious process of hand sorting from a large volume stream. The coin concentrator, proposed for United States patent, provides the following: a means of concentrating the metallic coins from a portion of mixed heavy metals to substantially reduce the amount of hand sorting required to extract the metallic coins.

SUMMARY OF THE INVENTION

A separator is disclosed for mechanically separating objects having one size dimension less that a predetermined threshold size. The present separator comprises a cylindrically- or barrel-shaped device having one or more louvers. The barrel is oriented at a preset angle and rotated about its longitudinal axis (along its circumference) by means of an drive. A collection of objects (processed materials or heavy metal particles from shredder operation) are introduced into the higher opening in the barrel. As the collection of objects progress downward through the barrel, a plurality of machined slots or louvers, separating the larger objects from the smaller. The present invention produces two products: an overflow, comprised essentially of objects that exceed the maximum allowable size through the louvers and fall through the lower end of the device; and an underflow, comprised essentially of objects that are able to pass through the louvers and are collected separately from the overflow. This separator effectively mechanizes the concentration of coins from the dissimilarly shaped heavy metals. In doing this, not only is the need for costly manual labor reduced, but so is the time required to process the mixed heavy metal material.

BRIEF DESCRIPTION OF THE DRAWINGS

The novel features believed characteristic of the present invention are set forth in the appended claims. The invention itself, however, as well as a preferred mode of use, further objectives and advantages thereof, will be best understood by reference to the following detailed description of an illustrative embodiment when read in conjunction with the accompanying drawings wherein:

Other features of the present invention will be apparent from the accompanying drawings and from the following detailed description.

DETAILED DESCRIPTION OF THE INVENTION

The present invention is directed to a separator for effectively mechanizing the concentration of coins from the dissimilarly shaped heavy metals. In doing this, not only does it overcome the prior art's need to reduce costly manual labor, but it also reduces the time required to process the mixed heavy metal material for sorting coinage from the heavy metals. The objects and advantages of the present separator are better understood with the description of figures below.

The present invention is described with respect to exemplary embodiments illustrated in FIGS. 1 through 4 which are suitable for separating a concentration of metallic coins from a mixed collection of irregularly-shaped heavy metal objects produced from an automobile shredder operation. The present invention is also suitable for separating various other materials, based on solid particles having a maximum size in any one spatial dimension being less than an opening size in a fabricated louver as will become apparent from the descriptions below.

Figure 1:
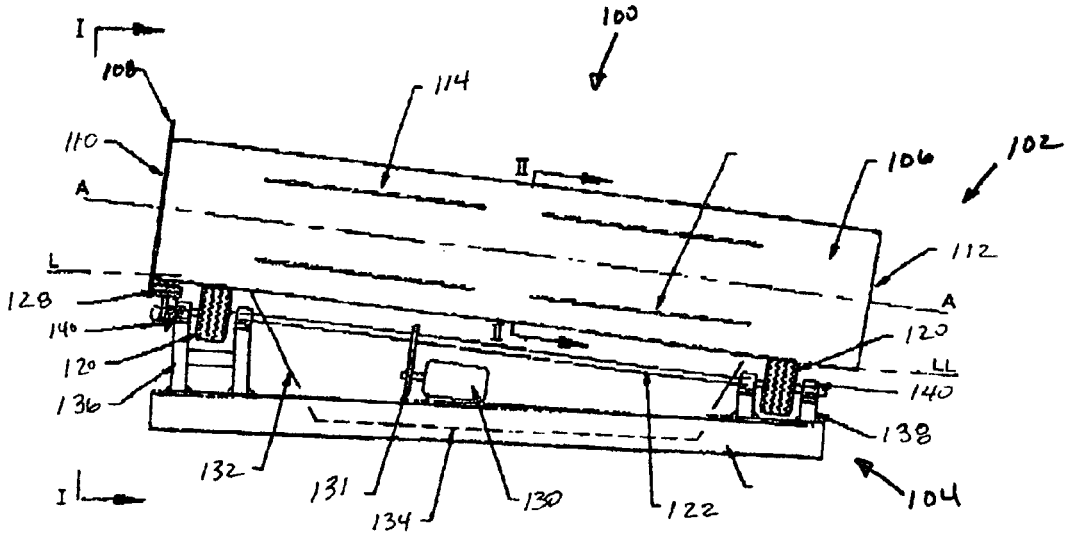
FIG. 1 is a side view of a separator in accordance with an exemplary embodiment of the present invention.
Figure 2:
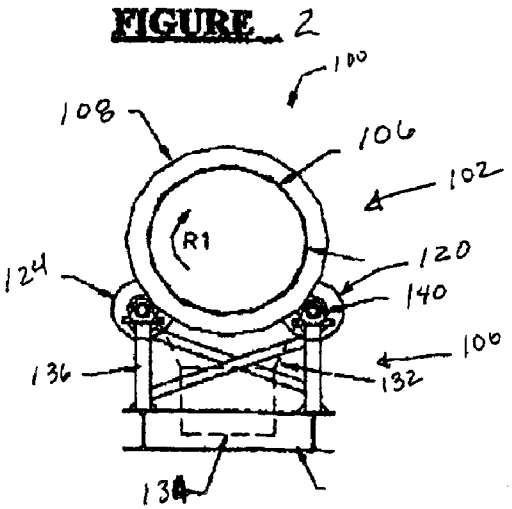
FIG. 2 is a cross-sectional view of the present separator in accordance with an exemplary embodiment of the present invention.

FIG. 1 is a diagram of an exemplary separator for sorting objects by size and shape as viewed from the side. FIG. 2 is a cross-sectional view of the separator as viewed from cross-section I—I depicted in FIG. 1. The present invention will be described with regard to both FIGS. 1 and 2 simultaneously. In accordance with an exemplary embodiment of the present invention, separator 100 comprises two basic subparts: rotated barrel assembly 102; and powered base assembly 104. Rotated barrel assembly 102 is comprised of hollow, substantially cylindrically-shaped barrel 106, having an essentially rounded cross-sectional shape with openings at either end. Flange 108 is securely fastened to one end of barrel 106 in such a way as to not completely obstruct input opening 110. The opposite end of barrel 106 from input opening 106 is discharge opening 112. Longitudinally along barrel 106 are a plurality of slots or louvers 114 which are fabricated in or disposed onto barrel 106. Louvers may be disposed in a generally longitudinal orientation to barrel 106, or alternatively may be disposed in a spirally-wound slot fashion about barrel 106 (not shown). The structure of louvers 114 will be discussed in detail below with regard to the longitudinal louver configuration; however, the function of louvers 114, in either configuration, is to provide a pathway for objects not exceeding a maximum size to exit barrel 106.

Briefly, a collection of solid objects is fed into barrel 106 of separator 100 through input opening 110 and the collection is separated in two fractional discharges based on the size of the objects in the collection and the magnitude of an opening in one or more louver(s) 114. The first fractional output, the "underflow," comprises objects with a dimension less than the magnitude of the louver's opening and is extracted mechanically from the collection. The second fractional output, the "overflow," passes directly through the entire longitudinal extent of barrel 106 and is discharged from discharge opening 112.

Powered base assembly 104 provides vertical support and rotational power for barrel assembly 102 and a collection hopper for the underflow objects. In the depicted example, the outer body of barrel 106 rests on four rollers, two positioned on either side of the longitudinal axis A—A of barrel 106 and on each side of one roller disposed toward input opening 110 and the other roller is disposed toward discharge opening 112. One of ordinary skill in the art would recognize that the rollers may take many forms, but are presently depicted as pneumatic tires 120 and pneumatic tires 124. The inner face of flange 108 is abutted against pneumatic idler tire 128. Pneumatic tires 120 are securely mounted on axle 122 and pneumatic tires 124 are mounted on axle 126. The position of barrel 106 is held relatively constant with respect to powered base assembly 104 by pneumatic idler tire 128 and parallel to the longitudinal axis A—A of barrel 106 by pneumatic tires 120 and pneumatic tires 124.

Rotational power is delivered to one or both of axles 122 and 126 from motor 130 by drive 131 which may be implemented as, for example, a belt, chain or gear drive assembly. The rotational power is transferred from one or both of axles 122 and 126 to pneumatic tires 120 and/or pneumatic tires 124 and on to barrel assembly 102 by frictional couplings between pneumatic tires 120 and/or 124 and barrel assembly 102. Idler tire 124 is not mechanically driven.

A pair of input end vertical support members 136 provide vertical support for the input ends of axles 122 and 126, while discharge vertical support members 138 provides vertical support for the discharge ends of axle 122. Discharge vertical support members 138 are shorter than the aforementioned input vertical support members 136. Axles 122 and 126 are rotationally supported on vertical supports 136 and 138 by, for example, pillow block bearings 140. Although not depicted in the present figures, input vertical supports 136 and/or discharge vertical supports 138 may further comprise height adjustment mechanisms for altering the vertical height of the respective support; exemplary adjustment mechanisms include interlocking screw, or hydraulic jacks or the like.

In the depicted example axles 122 and 126 rotate counterclockwise causing barrel 110 to rotate in a clockwise rotational direction as illustrated by arrow R1 shown in FIG. 2. Rotation ensures the collection of solid objects fed into barrel 106 which continue on a path essentially perpendicular to louver(s)114 and toward discharge opening 112. Of course, only the overflow objects traverse the full extent of barrel 106 to discharge opening 112; underflow objects exit barrel 106 through louvers 114 into collection hopper 132 and finally into discharge 134. The underflow fraction of objects and the overflow fraction of objects are separated based on a predetermined dimensional size threshold for the objects. The collection of objects traverses the longitudinal extent of barrel 106 by gravity, thus input opening 110 is fixed at a higher relative vertical position, height L, than the vertical position of discharge opening 112, height LL. Barrel 106 is oriented downward toward discharge opening 112. Since barrel 106 is supported by pneumatic tires 120 and pneumatic tires 124, which are mounted on axles 122 and 126, respectively, axles 122 and 126 are oriented at approximately the same angle as barrel 106. This is accomplished by maintaining the input end vertical support members 136 at a higher vertical position relative to that of discharge vertical support members 138. Any object with a dimensional measurement in any spatial plane that is less than that of the opening in louver(s)114 will be extracted from the collection of objects. The structure and function of louver(s)114 are directly discussed below.

Figure 3:
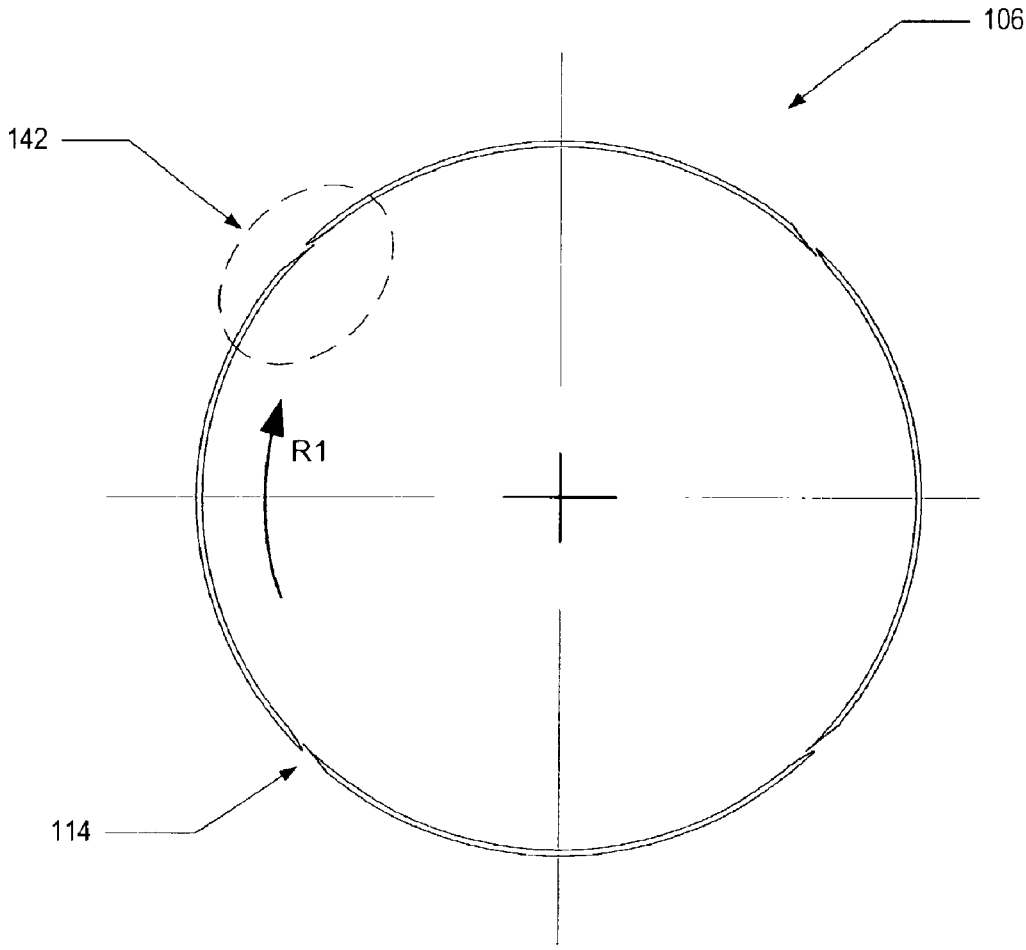
FIG. 3 is a cross-sectional view of a barrel portion of the present separator in accordance with an exemplary embodiment of the present invention.
Figure 4:
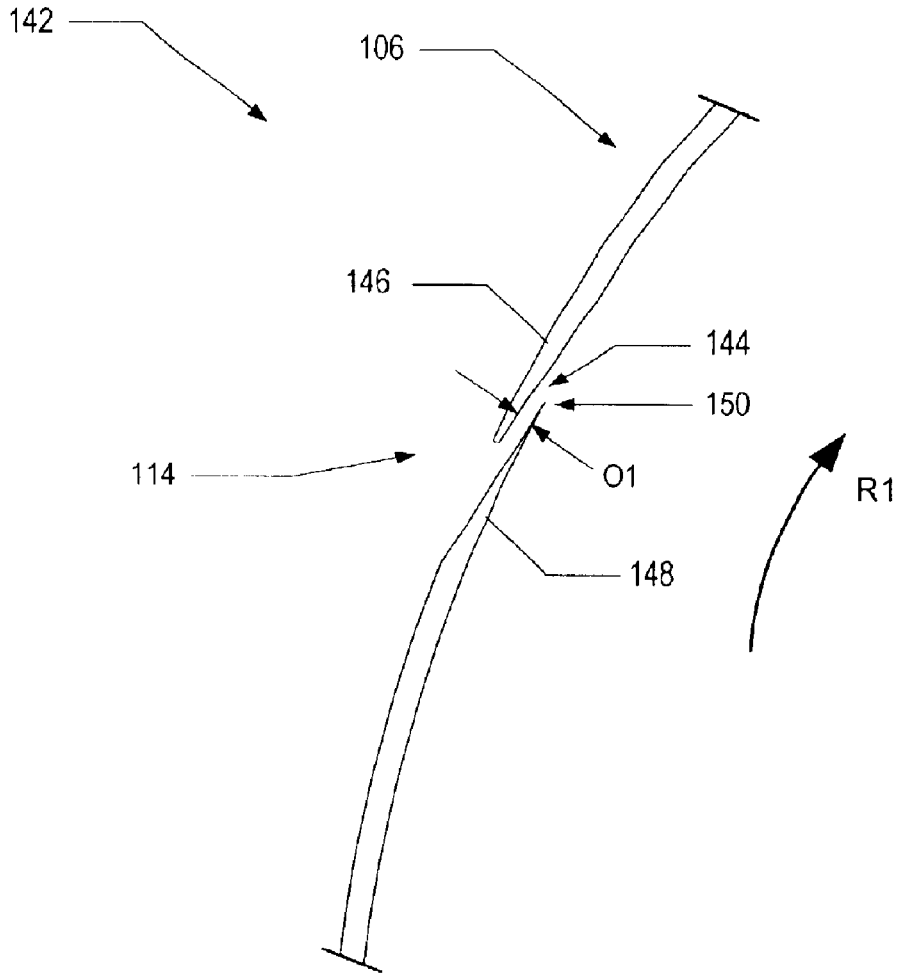
FIG. 4 is a magnified view of a portion of the cross-sectional view of the present barrel depicted in FIG. 3 including a louver in accordance with an exemplary embodiment of the present invention.

FIGS. 3 and 4 are cross-sectional views of portions of barrel 106 in accordance with exemplary embodiments of the present invention. FIG. 3 is a cross-sectional view of barrel 126 taken from cross-section II—II shown in FIG. 1. FIG. 4 is a magnified view of section 142 of barrel 106 including a portion of louver 114. In accordance with an exemplary embodiment of the present invention, louver 114 is comprised of a longitudinal slot or louver opening 144 formed by a separation between outer flap 146 and inner flap 148. Distance O1 between opposing outer flap 146 and inner flap 148 is based on a maximum dimensional size of objects to be separated. Distance O1 is equal to the predetermined maximum size alluded to above. Edge 150 is formed on the innermost extent of inner flap 148 and is oriented toward the direction of rotation, i.e. if rotation R1 is clockwise, then edge 150 points toward the clockwise direction; alternatively, if rotation R1 is counterclockwise, then edge 150 points toward the clockwise direction. Opening 144 should therefore be oriented toward the direction of rotation. As barrel 106 rotates, edge 150 contacts the lower strata of the collection of objects containing the objects, which, due to gravity, remain in contact with the inner surface of barrel 106. Objects having a dimensional size less than distance O1 are captured by edge 150 and separated from the collection. Those underflow objects exit barrel 106 through opening 144 and are expelled into hopper 132.

Notice also that opening 144 is approximately parallel to the inner surface of barrel 106. Therefore, in order for an object to be captured by edge 150 into opening 144, the object must have a dimensional size less than that of opening 144 and that dimension of the object must also be oriented parallel to opening 144. Here, it should be understood that, in general, the linear magnitude of one dimension of an object must be smaller than the maximum threshold for an object to pass through opening 144 in louver 114. Irregularly-shaped objects, those objects having one side with a linear measurement less than the predetermined maximum threshold size may not pass through the opening in louver 114 for two possible reasons. First, because one side of the object is smaller than the predetermined maximum threshold size, the object thickens away from the side and therefore will not completely pass through opening 114. The second reason is due to an object not having a general planar shape, and although a diameter of the object is less than the predetermined threshold amount, the dimension measurement of the object is greater than the threshold due to the nonplanarity of the object. Irregularly-shaped objects may initially enter opening 144 in louver 114 but then become lodged, thus requiring manual removal of the objects. Thus, the size of opening 144 should be determined by the size of object intended for sorting for optimal sorting results. From the foregoing, it should be clear that the present invention is particularly suited for sorting planar objects through the underflow, wherein the opposing outer planar surfaces of the object are separated by less than the predetermined maximum threshold amount. However, in order to be captured by edge 150 into opening 144, the planar surfaces should be approximately parallel to the inner surface of barrel 106. In accordance with one exemplary embodiment of the present invention, barrel 106 is comprised of two (2) sets of four (4) louvers 114 that are disposed radially about the barrel. In accordance with one exemplary embodiment, each louver 114 has a longitudinal slit (opening 144) in a generally parallel orientation with said longitudinal axis A of barrel 106. In accordance with another exemplary embodiment of the present invention, barrel 126 opening distance O1 is equal to approximately one eighth inch (0.125") for separating specific types of planar objects to the underflow path, i.e. coinage minted in the United States. Thus, in a mixed heavy metals system, made up of shredder residue, particularly automobile particulates, monetary metallic coinage concentrate is discharged at opening 114, while all remaining shredder residue is evacuated from separator 100 at discharge opening 112. One of ordinary skill in the art would readily appreciate that the magnitude of opening distance O1 may be adjusted to any distance based on the application of separator 100.

Louver(s) 114 may be physically constructed using any one of a plurality of methods. In accordance with one exemplary embodiment, louver 114 is fabricated directly into the wall of barrel 106 using any well-known machine milling and/or grinding process. In accordance with another exemplary embodiment, louver 114 is fashioned from a pair of flaps, outer flap 146 and inner flap 148, which are affixed to barrel 106 forming opening 144. Outer flap 146 and inner flap 148 may be permanently affixed across an opening in barrel 106 by welding the flaps directed to barrel 106 or temporarily affixed across an opening in barrel 106 using removable fasteners. Regardless of which method is employed, louver(s) 114 should be constructed from durable materials as the movement of the collection of objects in barrel 106 has a high abrasive effect on the contact surfaces. Additionally, regardless of how louver(s) 114 are affixed to barrel 106, the inner surfaces of flaps 146 and 148 should maintain a continuous circumference defined by the continuous inner surface of barrel 106.

Alternatively, barrel assembly 102 further comprises an axle disposed coaxially with axis A–A within barrel 106 and secured by rigid interior support members to the interior surface of barrel 106 (not shown). The axle extends beyond input opening 110, on the first end of barrel 106, and beyond discharge opening 112 on the second end of barrel 106. In which case, the coaxially positioned axle is rotationally supported near the opening end by a first vertical support member and near the discharge end by a second vertical support member by, for example, pillow block bearings affixed to the respective vertical members (also not shown). Rotational power is delivered to the axle from motor 130 by a belt or gear drive assembly as described above (not shown). Again, the opening end of barrel 106 is maintained at a higher vertical position relative to that of discharge end in order to affect gravity feed of the collection of objects through the barrel. Therefore, the rotational support near the input opening is positioned vertically higher than the rotational support near the discharge opening of barrel 106.

It will thus be seen that the objects set forth above, and those made apparent from the foregoing description, are effectively attained, and since certain changes may be made in the above construction without departing from the scope of the invention, it is intended that all matters contained in the foregoing description or shown in the accompanying drawings shall be interpreted as illustrative and not in a limiting sense. It should also be understood that the following claims are intended to cover all of the generic and specific features of the invention herein described, and all statements of the scope of the invention which, as a matter of language, might be said to fall there between.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention and the practical application, and to enable others of ordinary skill in the art to understand the invention for various embodiments with various modifications as are suited to the particular use contemplated.

What is claimed is:

1. Apparatus for separating a collection of objects containing metal coins into a first underflow path for receiving the coins based on a predetermined maximum size threshold and a second overflow path of other objects comprising:

a barrel assembly comprising:

a barrel, said barrel being defined on a longitudinal axis as having an essentially circular cross-sectional wall along said longitudinal axis with an essentially hollow interior and an outer surface, said barrel further having an input opening at an essentially first longitudinal extent of said barrel for receiving a collection of objects, and a discharge opening at an essentially second longitudinal extent of said barrel for discharging an overflow path of objects having a dimensional size greater than said predetermined maximum size of the metal coins; and at least one louver disposed on said barrel, said louver being in the form of at least one longitudinal slit in said barrel wall formed by a separation between an outer flap of said barrel wall and an inner flap of said barrel wall, said slit being in a generally parallel orientation with said longitudinal axis of said barrel, said slit forming an opening in said wall of said barrel extending from said hollow interior to said outer surface of said barrel, said opening having a dimensional magnitude less than or equal to the predetermined maximum size threshold for discharging an underflow path of said metal coins having a dimensional size less than said predetermined maximum size; and a powered base assembly for providing vertical support to said barrel assembly and rotational power for rotating said barrel assembly in a predetermined rotational direction.

2. The apparatus recited in claim 1 above, wherein said opening formed by said slit on said louver is oriented toward the predetermined rotational direction.

3. The apparatus recited in claim 1 above, wherein said louver further comprises:

an outer flap; and an inner flap, wherein said longitudinal slit in said barrel wall is defined by an overlapping separation between said inner flap and said outer flap and said separation forms said opening.

4. The apparatus recited in claim 1 above, wherein said inner flap has an innermost extent forming an edge, and wherein said edge contacts said collection of objects and captures said metal coins to said opening.

5. The apparatus recited in claim 1 above, wherein said a powered base assembly further comprises:

a plurality of rollers for providing support to said barrel assembly; and at least one power roller for transferring rotational power to said barrel.

6. The apparatus recited in claim 1 above, wherein said dimensional magnitude of said opening being no greater than one eighth inch (0.125") and said underflow path of objects comprising coinage minted in the United States.

7. The apparatus recited in claim 1 above wherein said powered base assembly further comprises:

a first vertical support for supporting said barrel assembly toward said input opening of said barrel; and a second vertical support for supporting said barrel assembly toward said discharge opening of said barrel, said second vertical support being shorter in the vertical direction than said first vertical support and thereby supporting said discharge opening of said barrel in a lower vertical position relative to said input opening of said barrel.

8. The apparatus recited in claim 7 wherein said a powered base assembly further comprises:

an axle.

9. The apparatus recited in claim 8 wherein said powered base assembly further comprises:

at least one roller mounted on said axle, said roller being in contact with said outer surface of said barrel.

10. The apparatus recited in claim 8 wherein said a powered base assembly further comprises:

a motor for providing rotational power for rotating said barrel in a predetermined rotational direction; and one of a belt drive, chain drive and gear drive for transferring rotational power to said axle.

11. The apparatus recited in claim 9 wherein said a powered base assembly further comprises:

a motor for providing rotational power for rotating said barrel in a predetermined rotational direction; and one of a belt drive, chain drive and gear drive for transferring rotational power to said axle.

12. The apparatus recited in claim 1 further comprising:

a second louver disposed on said barrel, said second louver being in the form of at least one additional longitudinal slit in said wall formed by another separation between an outer flap of the barrel wall and another inner flap of the barrel wall, said at least one additional longitudinal slit being in a generally parallel orientation with said longitudinal axis of said barrel; said additional longitudinal slit forming an opening in said wall of said barrel extending from said hollow interior to the exterior surface of said barrel, said opening having a dimensional magnitude less than or equal to the predetermined maximum size threshold for discharging an underflow path of said metal coins, said underflow path of objects having a dimensional size less than said predetermined maximum size.

* * * * *